United States Patent [19]

Hackert

[11] Patent Number: 5,064,595

[45] Date of Patent: Nov. 12, 1991

[54] PROCESS FOR RETAINING FIBER WHITENESS

[75] Inventor: Raymond L. Hackert, Salisbury, Md.

[73] Assignee: E. I. Du Pont de Nemours and Company, Wilmington, Del.

[21] Appl. No.: 388,924

[22] Filed: Aug. 3, 1989

Related U.S. Application Data

[63] Continuation-in-part of Ser. No. 147,159, Jan. 22, 1988, abandoned.

[51] Int. Cl.[5] ..... D01F 11/04

[52] U.S. Cl. ..... 264/130; 264/129; 264/211.14; 8/584

[58] Field of Search ..... 8/584; 264/130, 129, 264/211.14

[56] References Cited

U.S. PATENT DOCUMENTS

| | | | |
|---|---|---|---|
| 3,052,653 | 9/1962 | Iannicelli | 5/584 |
| 3,448,087 | 6/1969 | Ballentine et al. | 5/584 |

FOREIGN PATENT DOCUMENTS

| | | | |
|---|---|---|---|
| 2146760 | 3/1973 | Fed. Rep. of Germany | 8/584 |
| 60-259674 | 12/1985 | Japan | 8/584 |
| 63-135581 | 6/1988 | Japan | 8/584 |

*Primary Examiner*—Hubert C. Lorin

[57] ABSTRACT

More whiteness, especially for nylon fibers, is retained when a finish is used to provide to the fiber surface an effective amount of a phenyl phosphinate. Potassium phenyl phosphinate, in amounts as small as 0.005% to 0.3% by weight of the fiber, is particularly effective.

8 Claims, No Drawings

PROCESS FOR RETAINING FIBER WHITENESS

CROSS-REFERENCE TO RELATED APPLICATION

This application is a continuation-in-part of copending application Ser. No. 07/147,159, filed Jan. 22, 1988, now abandoned.

BACKGROUND OF THE INVENTION

1. Field of the Invention

This invention relates to a process for preparing textile fibers, especially nylon fibers, and more particularly concerns improving their whiteness by adding a phenyl phosphinate using an improved technique.

2. Background Art

In the conventional production of textile fibers of synthetic organic polymers, it is customary to add certain chemicals to the polymer for various purposes. Among such additives are pigments, antioxidants, ultraviolet screeners, delusterants, antistatic agents, whiteners and the like. The addition of various phenyl phosphinate salts and combinations thereof to nylon polymers to inhibit yellowing of the resulting nylon yarns is known from the disclosures of several patents, such as U.S. Pat. Nos. 3,374,288 (Lange), 3,947,424 (Tomek), and 2,981,715 (Ben). Indeed, in the commercial production of some melt-spun nylon filaments, the agents added to the polymer have included sodium phenyl phosphinate and a hindered phenol, as antioxidants, titanium dioxide and polyethylene oxide. Such fibers have, nevertheless, been noted to yellow on exposure to heat and light. Attempts to solve this problem by the addition of more sodium phenyl phosphinate in the polymer sometimes causes problems. Sodium phenyl phosphinate is insoluble in molten nylon-66. Such insolubility can lead to the formation of spherulites in the yarn during melt spinning, which in turn can alter the luster of the yarn and give it a chalky appearance, as well as cause more weak spots in the yarn which can lead to more broken yarns.

Accordingly, there has still been a real need to prepare a fiber that has improved resistance to yellowing, without encountering additional problems.

Conventional production of textile fibers generally includes application of an oil or an aqueous finish to the surface of the fibers. The customary purposes of the finish are to protect the fibers from damage by subsequent contact with machinery and to improve antistatic and tactile properties of the fibers. In addition to water or oil as the main ingredient, such finishes customarily include various chemical compounds depending on the anticipated use of the fiber. Among typical finish ingredients are mixtures of surfactants, lubricants, emulsifiers, antioxidants, antistatic agents and the like.

SUMMARY OF THE INVENTION

I have discovered how to make fibers that can retain their whiteness without such difficulties as used to be encountered previously. In essence, a suitable phenyl phosphinate is applied to the surface of the fibers after fiber formation. Surprisingly, this provides benefits beyond those obtained by incorporating additives in the polymer before extrusion to form the filaments. A convenient technique is to include the phenyl phosphinate in the finish. Surprisingly, I have found that fibers whose surface has been coated with these phenyl phosphinates, applied in the finish after melt-spinning, retain their whiteness well, although this additive has not been dispersed throughout the polymer, as taught in the prior art.

According to the present invention, therefore, I provide a process to improve the whiteness retention of synthetic polymer fibers, involving adding an effective amount of a phenyl phosphinate additive selected from the group consisting of a Group Ia metal phenyl phosphinate salt and of phenyl phosphinic acid, in a process including the steps of melt-spinning the synthetic polymer into filaments, of applying a finish onto the surface of the filaments to facilitate subsequent processing, and of packaging the filaments, the improvement being characterized by applying the phenyl phosphinate additive to the surface of the filaments with the said finish as claim 1.

Group Ia metal salts are preferred, especially those wherein the metal is selected from potassium, sodium and lithium salt, most preferably potassium. The effective amount is usually in the range of 0.005 to 0.3%, preferably 0.05 to 0.2%, based on the weight of the fiber. Fiber of polyhexamethylene adipamide polymer, a total amount of finish (dry) in the range of 0.5 to 3% by weight of the fiber, and finishes which also provide to the surface lubricants, antistats, and antisoil agents are preferred.

DETAILED DESCRIPTION OF PREFERRED EMBODIMENTS

The terms "filaments" and "fibers" are not used herein mutually exclusively.

The phenyl phosphinates suitable for use in the present invention are Group Ia metal salts, or the acid. The preferred metals are potassium, sodium and lithium. Potassium is the most preferred metal for these salts because potassium salt is the salt that dissolves most readily in typical fiber finishes in concentrations that are sufficiently high to be effective in reducing the propensity of the fibers and of the other finish ingredients to become yellow when exposed to heat and/or light. Although the sodium phenyl phosphinate is useful in reducing yellowing, the sodium salt is less soluble than the potassium salt in various finish oils and reduces the stability of the finish emulsion. Because of its higher cost, the lithium salt is less preferred.

As used herein, the term "effective amount" refers to the amount of phenyl phosphinic acid or phenyl phosphinate salt that reduces propensity of the fiber and finish to yellow on exposure to heat and/or light. Generally, as little as 0.005 % based on weight of the fiber, can improve the yellowing resistance. Higher concentrations are usually more effective. However, concentrations of greater than 0.3 % are unecessary. Also, higher concentrations generally are not employed, because of problems associated with the solubility of the additive in the finish. The preferred amount of phenyl phosphinate is in the range of 0.05 to 0.2%, based on fiber weight.

The concentrations of phenyl phosphinic acid or phenyl phosphinate salt in finishes that are suitable for use in the present invention depend primarily on the solubility limits of the acid or salt in the finish. Usually, the concentration of the phenyl phosphinic acid or phenyl phosphinate salt, based on the weight of the total finish (dry), is in the range of 0.5 to 15%, preferably 1 to 8%. When aqueous application of the finish is employed, high concentrations of the acid or salt are avoided to prevent build-up of deposits on processing equipment. Low concentrations of the acid or salt are avoided to obviate evaporation of large quantities of finish water from the fibers.

The finish is preferably made up as a batch and then applied to the yarn by conventional techniques, such as by means of finish rolls, spray applicators, and the like. Preferably the finish is applied from an aqueous mixture, rather than from an oil mixture. Aqueous finishes are preferred for textile fibers in accordance with the invention because the phenyl phosphinates are much more soluble in water than in most finish oils and therefore can be applied in larger concentrations to the fiber surface from aqueous finishes than from oil finishes.

The finish can be applied to the textile fibers in accordance with the invention at any point in the production process after melt spinning of the polymer. Thus, the finish can be applied before filament drawing or thereafter, including use as an overlay finish (one that is applied over another finish). It is generally preferable to apply the phenyl phosphinate before exposing the fibers to heat and/or light, so that the phenyl phosphinate may be effective.

In the Examples which follow, the invention is illustrated with fibers made of nylon-66, i.e. a polymer of hexamethylene adipamide. Although the invention is particularly advantageous for such fibers, other polymeric fibers also can benefit from finishes made in accordance with the invention. Such other fibers may be made of polyamide, polyester, polyolefin, acrylic, spandex, etc. polymers, including copolymers.

The particular polymer employed to produce the fibers of the examples below was a commercial polymer of polyhexamethylene adipamide (nylon-66) containing, as additives, 0.15 % of titanium dioxide delusterant, 0.5 % of polyethylene oxide luster-modifying agent, 0.05 % of "Ethanox"-330 (1,3,5-trimethyl-2,4,6-tris(3,5-di-t-butyl-4-hydroxy-benzyl)benzene, manufactured by Ethyl Corp. of Baton Rouge, Louisiana), 0.12 % of sodium phenyl phosphinate and 0.004 % of manganese hypophosphite, the latter three additives being antioxidants (all percentages being based on the weight of the fiber).

The following tests were used to measure characteristics of the fibers reported herein.

The amount of finish applied to a yarn was determined by extracting the finish from the yarn with 1,1,1-trichloroethane (also known as methyl chloroform), evaporating the extract to dryness and then weighing the dried extracted finish.

A Hunterlab Ultrascan Sphere Spectrocolorimeter, sold by Hunter Associates Laboratory, Inc., of Reston, Virginia, was used to determine b* reflectance values with the instrument arranged for "spectral" and "large area view" measurements. Other instrument settings for the measurements were:

Color Scales: CIELAB
Color Difference: DELTA E CIELAB
Illuminants: D65
Observer: 10 degrees
Delta Descriptors: Rectangular
Indices: MI
Wavelength Range: Visible
Calibrations: Light Trap (black) to zero; White (Tile) Standard; Gray (Tile) Standard Four reflectance measurements were made on multiple four portions of hand-compacted 5-to-15-gram samples of opened staple fibers and then averaged to provide the reported b* values. A b* value of 1 corresponds to a very white sample. A b* value of less than 2.5 is considered to represent a real improvement over the whiteness of current commercial nylon staple yarns. A b* value of 3.4 is typical of current commercial nylon staple yarns. Staple yarns produced with nylon fibers of the invention generally have b* values in the range of 1.8 to 2.4 and are considered to have excellent whiteness.

For each of the yarns of the invention and the comparison yarn illustrated in the Examples below, the polymer was melt spun into filaments (98% of which were trilobal and 2% of which were of circular cross-section) and air quenched on a commercial spinning machine to form filaments that were the same in all respects (except for finish) as filaments used for making commercial 15-291AS carpet yarns (manufactured by E. I. du Pont de Nemours and Company). Filaments from each spinning position were combined into an as-spun yarn rope and guided into a collection can, which is a typical package used for staple processing. As-spun ropes from six collection cans were combined into a single large rope, which was fed to a conventional drawing operation, wherein the large rope was drawn about 3X and then stuffer-box crimped to yield a drawn and crimped tow. Four ends of the tow were then plied together, cut into staple fibers and baled. A bale is a typical package for staple fiber (whereas a typical package for a continuous filament yarn is a bobbin). The fibers averaged 15 denier per filament and 7.5 inches (19 cm) in length.

EXAMPLE 1

This Example illustrates the application of potassium phenyl phosphinate in a spin finish to freshly melt-spun nylon fibers and compares the resultant yarn to a commercial yarn made of the same polymer but with a commercial lubricating finish that does not contain potassium phenyl phosphinate.

The following ingredients were used to prepare a spin finish for use in accordance with the invention:

1. A conventional lubricant emulsion, in the form of an aqueous emulsion, containing about 16% of active ingredients which consist of about 70% of heat-stable mixed ester lubricants, 10% of a propylene oxide/ethylene oxide copolymer emulsifier and 20% of a neutralized phosphate antistat.
2. Demineralized water.
3. Potassium phenyl phosphinate supplied as a 50% solution in water.
4. A fluorocarbonylimino biuret antisoil agent of the type disclosed by Pechhold, European Patent Application Publication 0 172 717 A2.

The ingredients were mixed in the order listed above to provide a spin finish having the following composition, in which all listed percentages are based on the total weight of the finish:

Lubricant emulsion: 12.6 %
Potassium phenyl phosphinate: 1.0 %
Fluorocarbonylimino biuret antisoil agent: 2.4 %
Water: 84.0 %

The finish was applied to as melt-spun and quenched nylon filaments during the filament production by means of a rotating cylindrical finish roll located just downstream of the quench chimney and upstream of the point where the as-spun-and-quenched filaments were combined into a rope. The finish roll rotated with its lower surface continuously dipping into a pool of the finish, thereby forming a film of the finish on the outer curved surface of the roll as it rotated out of the pool. As the melt-spun-and-quenched nylon filaments were being forwarded to downstream equipment, the filaments were brought into contact with and spread across the curved surface of the rotating roll. As a result, the filaments picked up finish solution in an amount equal to 1.42 % of dry finish, the percentage being based on the weight of the filaments.

Cut and baled staple fibers made from the filaments described above were subjected to tests that simulated conventional techniques for processing staple fibers into carpets. The tests included opening, carding, drafting, spinning, plying, heat-setting, tufting into a carpet backing, dyeing and finishing. The staple fibers treated with the finish of this example performed fully satisfactorily in all these tests.

For purposes of comparison, commercial nylon staple yarns made in the same way as the yarns of this example, but having applied to their surface 1.50% of a commercial finish, were processed through the same test procedure. The composition of the commercial finish was about 54% of a coconut oil lubricant, 18% of a polyethylene oxide emulsifier, 23% of a neutralized mixture of cationic and anionic antistats, 2% of a neutralized sulfated triglyceride emulsifier, <1% of "Aerosol OT" wetting agent (sold by American Cyanamid) and 2% "Naugard PHR" antioxidant (sold by Uniroyal). The control yarns performed no better than the yarns of the invention in any of these tests. Furthermore, the processed fibers of the invention were significantly whiter than the control fibers, in that the fibers of the invention exhibited a Hunter Spectrocolorimeter b* value of 2.2 versus 3.4 for the comparison fibers.

EXAMPLE 2

This Example further illustrates the invention and compares it with fibers having the commercial spin finish of Example 1. Potassium phenyl phosphinate is employed in conjunction with citric acid in a lubricating finish to provide whiter staple nylon yarn than is obtained with the same nylon yarn with the commercial finish. Note that the commercial finish has significant amounts of chemical unsaturation and is known to have a propensity to yellow when heated in air.

A spin finish was prepared by mixing the following ingredients in the order shown:

1. The commercial finish of Example 1 to provide 12.3% active ingredient in the final finish composition.
2. Demineralized water to provide 16% toal active ingreients in the final finish composition.
3. Citric acid to give 0.3% citric acid in the final finish composition.
4. Potassium phenyl phosphinate, as a 50% aqueous solution, to provide a 1% concentration of the phosphinate in the final finish composition.
5. The same fluorocarbonylimino biuret antisoil agent as in Example 1, to provide a 2.4% of the agent in the final finish composition.

The above-described finish was applied as in Example 1 to as-melt-spun-and-quenched nylon filaments to provide 1.52% of finish on the filaments. The filaments were then processed satisfactorily into staple fiber yarns as in Example 1. For comparison, a control sample was prepared of commercial nylon staple yarns having 1.5% of the commercial finish of Example 1 on the surface of the filaments (i.e., the same finish as item 1 of the finish of this Example). The whiteness of the opened yarn of this Example and that of the control yarn were measured. The advantage of the yarn of the invention was clearly evident. The yarn of the invention had a b* value of 2.3 versus a value of 3.4 for the control yarn.

In this regard, it will be noted that both control yarns in these Examples did contain sodium phenyl phosphinate in the polymer, among other additives, but gave inferior results in the sense that the control yarns became yellower after fiber processing. Preferably, according to the invention, sufficient antioxidant(s) should be incorporated into the polymer to provide freshly-extruded filaments of the desired whiteness, and a phosphinate such as sodium phenyl phosphinate is useful for this purpose, as taught in the art. According to the invention, however, further protection is provided by adding the suitable phenyl phosphinate after melt-spinning so the whiteness of the spun filaments is retained better subsequently. A further advantage can be obtained by optimizing the other finish ingredients with regard to reducing any propensity to yellow subsequently.

I claim:

1. A process to improve the whiteness retention of synthetic polymer fibers, involving adding an effective amount of a phenyl phosphinate additive selected from the group consisting of a Group Ia metal phenyl phosphinate salt and a phenyl phosphinic acid, in a process including the steps of melt-spinning the synthetic polymer into filaments, of applying a finish containing an oil lubricant onto the surface of the filaments to facilitate subsequent processing, and of packaging the filaments, the improvement being characterized by applying the phenyl phosphinate additive to the surface of the filaments with said finish.

2. A process in accordance with claim 1, wherein an amount of the phenyl phosphinate in the range of 0.005 to 0.3% is applied, based on the weight of the fibers.

3. A process in accordance with claim 2 wherein the amount is in the range of 0.05 to 0.2%.

4. A process in accordance with claim 1, 2 or 3, wherein the phenyl phosphinate is a Group Ia metal phenyl phosphinate and the metal is selected from the group consisting of potassium, sodium or lithium.

5. A process in accordance with claim 4 wherein the metal is potassium.

6. A process in accordance with claim 1, 2 or 3 wherein the fiber is of hexamethylene adipamide polymer.

7. A process in accordance with claim 6, wherein said oil lubricant comprises a mixed ester lubricant and the finish is applied in amount between 0.5 and 3% of the weight of the fiber, and further provides to the fiber surface a phosphate antistat and a fluorocarbonylimino biuret antisoil agent.

8. A process in accordance with claim 6, wherein said oil lubricant is a coconut oil lubricant and the finish is applied in amount between 0.5 and 3% of the weight of the fiber, and further provides to the fiber surface emulsifiers and a mixture of anionic and cationic antistat.

* * * * *